US009790656B1

(12) United States Patent
McKnight

(10) Patent No.: US 9,790,656 B1
(45) Date of Patent: Oct. 17, 2017

(54) CONCRETE PILE CUTTING ASSEMBLY

(71) Applicant: T. J. McKnight, Inc., New Bern, NC (US)

(72) Inventor: Thomas J. McKnight, New Bern, NC (US)

(73) Assignee: T. J. McKnight, Inc., New Bern, NC (US)

( * ) Notice: Subject to any disclaimer, the term of this patent is extended or adjusted under 35 U.S.C. 154(b) by 0 days.

(21) Appl. No.: 15/072,444

(22) Filed: Mar. 17, 2016

(51) Int. Cl.
*E02D 9/00* (2006.01)
*B28D 1/04* (2006.01)

(52) U.S. Cl.
CPC ..... *E02D 9/005* (2013.01); *B28D 1/042* (2013.01); *B28D 1/045* (2013.01)

(58) Field of Classification Search
CPC ..... E02D 9/005; B28D 1/042; B28D 1/045; B23D 21/00–21/04; B23D 45/00–45/04; B23D 45/12; B23D 47/02; B23D 57/0084
See application file for complete search history.

(56) References Cited

U.S. PATENT DOCUMENTS 3,545,509 A * 12/1970 Baxter, Jr. ..... A01G 23/093 144/208.2
3,667,515 A 6/1972 Corey
4,144,867 A 3/1979 Wachs et al.
4,180,047 A 12/1979 Bertelson
4,197,828 A 4/1980 Schellhorn
4,233,954 A 11/1980 Visser
4,318,391 A 3/1982 Wachs et al.
4,327,703 A 5/1982 Destree
4,368,720 A * 1/1983 Destree ..... B23D 45/006 125/14
5,054,342 A 10/1991 Swiatowy et al.
5,090,397 A * 2/1992 Larsen ..... E02D 9/00 125/14
5,107,594 A * 4/1992 Ferreras ..... B27B 17/0058 30/372
5,545,079 A 8/1996 Larsson et al.
(Continued)

OTHER PUBLICATIONS

Farwest Steel Angle Iron weights from Jan. 2017 at //www.farweststeel.com/content/misc_uploads/FWS_Standard_Weights_and_Gauges1.pdf.*
(Continued)

*Primary Examiner* — Joseph J Hail
*Assistant Examiner* — Brian Keller
(74) *Attorney, Agent, or Firm* — Tuggle Duggins P.A.; Blake P. Hurt

(57) ABSTRACT

A concrete pile cutting assembly configured for cutting a concrete pile includes a cutting saw portion supported on a collar portion. The collar portion securely engages the concrete pile and mounts the cutting saw portion adjacent the concrete pile at a desired height such that a cutting blade of the cutting saw portion cuts, or severs, the concrete pile at the desired height. The collar portion includes a plurality of collar elements each having a beam, a connecting flange, and a locking fastener. The locking fastener of a first beam engages with a corresponding beam opening of a second beam to connect adjacent collar elements together. Each beam has at least one mounting cylinder and the cutting saw portion includes a post for engaging with one of the mounting cylinders provided on the beams to mount the cutting saw portion onto the collar portion.

11 Claims, 5 Drawing Sheets

(56) References Cited

U.S. PATENT DOCUMENTS

| | | | | |
|---|---|---|---|---|
| 6,431,655 | B1 * | 8/2002 | Mantovani | B28D 1/222 125/40 |
| 7,243,646 | B2 | 7/2007 | Todack | |
| 8,118,018 | B1 | 2/2012 | Sherment | |
| 8,276,577 | B2 | 10/2012 | Wills, II | |
| 2007/0209651 | A1 | 9/2007 | Ketterhagen et al. | |
| 2009/0288847 | A1 * | 11/2009 | Quiring | A01B 59/00 172/250 |

OTHER PUBLICATIONS

Groundworks eight (8) page brochure showing various "Kinhan" Concrete Pile Cutters; Copyright Groundwork Group Ltd—Apr. 2013.

Six (6) page printout from Aggregate Technologies, Inc. for articles entitled "Safe Pile Cutting" and "U.S. Pat. No. 8,276,577 for Pile Cutter"; Copyright (undated) Aggregate Technologies, Inc.

* cited by examiner

CONCRETE PILE CUTTING ASSEMBLY

FIELD OF THE INVENTION

The invention disclosed herein pertains generally to devices and methods for cutting a concrete pile. More particularly, the invention pertains to a concrete pile cutting assembly having a collar for securely engaging a concrete pile and for rotatably mounting a cutting saw to cut the concrete pile.

DESCRIPTION OF THE PRIOR ART AND OBJECTIVES OF THE INVENTION

Concrete piles, also commonly referred to as "pilings" and "columns," are utilized as structural supports in the construction of buildings, bridges, roadway overpasses and the like. In many instances, the structural supports are formed by pre-cast concrete piles that are driven into the earth. Typically, the heights of the concrete piles are uneven and/or the excess portion of the concrete pile above a desired height, such as the grade level of a building, must be removed in situ. It is also oftentimes necessary in the demolition of a structure to remove the portion of a concrete pile above ground level or above water level.

Several different types of devices exist for removing the excess height of a concrete pile. One such device is available from Aggregate Technologies, Inc. of Houston, Tex., and commercially known as a concrete Pile Cutting Machine (PCM). The concrete PCM grips a concrete pile above the desired height, cuts the concrete pile at the desired height, and removes the excess portion of the concrete pile. The device includes a grip assembly for holding the concrete pile and a cutting assembly positioned below the grip assembly with a concrete cutting saw for cutting the pile. The grip assembly and the cutting assembly are mounted on a three axis extension boom of an excavator for maneuvering the concrete PCM to the concrete pile and for removing the cut portion of the concrete pile.

Another type of device for cutting or trimming a concrete pile is available from Kinhan Heavy Industry Co., Ltd. of Jiangsu, China. The Kinhan concrete pile cutter includes a plurality of hydraulic chisels mounted on an annular cage that is suspended from an extension boom of a crane, excavator or the like. The cage is lowered over the concrete pile such that the hydraulic chisels are positioned at the desired height of the concrete pile. The hydraulic chisels are then reciprocated radially so as to cut, or break away, the concrete pile at the desired height. The excess portion of the concrete pile falls away, or alternatively, is lifted from the concrete pile in a manner that exposes the reinforcing material (e.g., rebar) above the desired height of the concrete pile for capping.

U.S. Pat. No. 4,144,867 issued to Wachs et al. on Mar. 20, 1979, discloses a concrete pile cutting machine including an annular frame that is configured to be positioned around the periphery of a concrete pile. Guide members are provided on the frame to align the frame with the concrete pile and movable clamps are provided to secure the frame on the concrete pile. An annular track provided on the frame is engaged by a cutter head having a drive means for moving the cutting head and a cutter-carrying arm along the annular track to engage, and thereby cut, the wall of the concrete pile.

U.S. Pat. No. 4,180,047 issued to Bertelson on Dec. 25, 1917, discloses a concrete pile cutting apparatus for cutting a concrete pile above ground level and above and below water level. The apparatus includes a frame that has a quadrangular transverse cross-section and is configured to receive a concrete pile centrally within the frame. The upper portion of the frame and the lower portion of the frame each carry extensible clamps for gripping the concrete pile above and below the location on the concrete pile to be cut. The center portion of the frame carries a plurality, and preferably a total of four, cutting saws. Each cutting saw is mounted on a carriage configured for transverse reciprocation to cut the concrete pile at the desired location.

U.S. Pat. No. 4,233,954 issued to Visser on Nov. 18, 1980, and assigned in part to Von Rohr Equipment Corporation of Bloomfield, N.J., discloses a portable concrete pile cutting device. The device includes a support collar adapted to be removably rigidly mounted in an annular manner around a concrete pile to be cut. The collar is configured to support at least one pile cutting assembly that is mounted on the collar adjacent the concrete pile for transverse reciprocation relative to the concrete pile. A cutting means of the pile cutting assembly is adapted to travel in a straight line to form a cut in the concrete pile that is generally transverse to the longitudinal (i.e., height-wise) axis of the pile and has a depth that is less than the thickness of the concrete pile.

The aforementioned concrete pile cutting machines, apparatus and devices while useful, are complex, cumbersome and/or costly to employ. It is therefore desirable to provide a concrete pile cutting assembly that overcomes the disadvantages of the existing machines, apparatus and devices. In particular, it is desirable to provide a concrete pile cutting assembly that is simple in design and relatively easy and cost efficient to employ. Furthermore, it is desirable to provide a concrete pile cutting assembly that securely engages a concrete pile and supports a cutting saw in a manner that allows the cutting saw to cut, or sever, the concrete pile. Further still, it is desirable to provide a concrete pile cutting assembly that can cut and remove a pile close to the mounting substrate surface without requiring the same proximity of a user.

In view of the aforementioned needs, the present invention was conceived and has as an objective to provide an improved concrete pile cutting assembly for cutting a concrete pile.

The present invention has as a further objective to provide a concrete pile cutting assembly having a collar that securely engages a concrete pile and supports a cutting saw without need for support equipment such as a crane, excavator, backhoe, or the like.

The present invention has another objective to provide a concrete pile cutting assembly having a collar with a binding member positioned therearound to ensure that the collar frictionally engages the concrete pile sufficiently to rigidly support both the collar and an associated saw during cutting operation.

The present invention has yet a further objective to provide a concrete pile cutting assembly having a collar that mounts a cutting saw adjacent a concrete pile in a manner that allows the cutting saw to cut, or sever, the concrete while the user remains standing.

Various other objectives and advantages of the present invention will become readily apparent to and appreciated by those skilled in the art as a more detailed description of exemplary embodiments of the invention is set forth below.

SUMMARY OF THE INVENTION

The aforementioned, as well as other objectives not expressly set forth herein, are realized by providing a concrete pile cutting assembly constructed according to the present invention as shown and described by the exemplary embodiments disclosed herein.

In one aspect, the present invention is embodied by a concrete pile cutting assembly including a collar portion configured for securely engaging a concrete pile and a cutting saw portion including a cutting blade. The collar portion is further configured to mount the cutting saw portion on the collar portion with the cutting blade of the cutting saw adjacent the concrete pile at a desired height to cut the concrete pile. The collar portion includes a plurality of substantially identical collar elements that are connected together to form the collar portion. In one embodiment each of the plurality of collar elements is an elongated beam and each beam has a generally rectangular cross-section. Each beam further has a predetermined longitudinal length and a predetermined lateral width. In another embodiment, each of the plurality of collar elements includes at least a beam, a locking rod and a locking insert. The locking rod of a first beam of a first collar element of the collar portion engages with the locking insert of a second beam of a second collar element of the collar portion to connect the first collar element and the second collar element together to form a cam action lock. In yet another embodiment, each of the plurality of collar elements further includes a connecting flange. In yet another embodiment, the locking rod includes an elongated shaft that terminates with an externally threaded end, and the locking insert has an internally threaded opening configured for engaging with the externally threaded end of the locking rod of another collar element. In still another embodiment, the cutting saw portion includes an operating handle having a leg that terminates with a post, and the collar portion has at least one mounting hole for receiving the post to mount the cutting saw portion on the collar portion.

In another aspect, the present invention is embodied by a collar for a concrete pile cutting assembly including a plurality of collar elements. Each collar element includes a beam, a locking rod and a locking insert. Each locking rod includes an elongated shaft that terminates with an externally threaded end and each locking insert has an internally threaded hole. Adjacent collar elements are connected together by the externally threaded end of the locking rod of a first beam of one of the plurality of collar elements engaging in a cam action manner with the internally threaded hole of the locking insert of a second beam of another one of the plurality of collar elements. In one embodiment, the beam of each collar element is an elongated beam having a generally rectangular cross-section. In another embodiment, the locking insert of each collar element includes a cap having a protrusion for aligning the internally threaded hole of the locking insert of the second beam with the externally threaded end of the locking rod of the first beam. In another embodiment, each collar element further includes a connecting flange, and the connecting flange of the first beam overlaps the second beam. In yet another embodiment, the plurality of collar elements securely engages the concrete pile cutting assembly with a concrete pile and has at least one mounting hole for receiving a cutting saw having a cutting blade such that the cutting blade of the cutting saw is positioned adjacent the concrete pile at a desired height for cutting the concrete pile.

In yet another aspect, the present invention is embodied by a method for cutting a concrete pile. The method includes providing a collar portion including a plurality of collar elements and providing a cutting saw portion including a cutting blade. The method further includes connecting the plurality of collar elements together and securely engaging the concrete pile with the plurality of collar elements connected together. The method further includes mounting the cutting saw portion on the collar portion such that the cutting blade is positioned adjacent the concrete pile. In one embodiment, connecting the plurality of collar elements together includes connecting a first beam of a first one of the plurality of collar elements to a second beam of another one of the plurality of collar elements using a locking rod of the first beam and a locking insert of the second beam. In another embodiment, mounting the cutting saw portion on the collar portion includes engaging a post on a leg of the cutting saw portion with a mounting hole provided on one of the plurality of collar elements. In yet another embodiment, the method further includes cutting through the concrete pile with the cutting blade of the cutting saw portion. In yet another embodiment, each of the plurality of collar elements includes a beam, a locking rod having an externally threaded end and cam action handle, and a locking insert having an internally threaded hole. In still another embodiment, connecting the plurality of collar elements together includes engaging the externally threaded end of a first locking rod of a first beam of one of the plurality of collars element with the internally threaded hole of the locking insert of a second beam of an adjacent one of the plurality of collar elements.

In one or more alternate embodiments, the present invention is embodied by a concrete pile cutting assembly including a collar portion configured for securely engaging a concrete pile and a cutting saw portion including a cutting blade. The collar portion is further configured to rotatably mount the cutting saw portion on the collar portion with the cutting blade of the cutting saw adjacent the concrete pile at a desired height to cut the concrete pile. The collar portion includes a plurality of substantially identical collar elements that are connected together to form the collar portion. In one embodiment each of the plurality of collar elements is an elongated beam and each beam has a generally rectangular cross-section. Each beam further has a predetermined longitudinal length and a predetermined lateral width. In another embodiment, each of the plurality of collar elements includes a pair of locking plates, each plate defining first and second ends, the first end rigidly affixed to the associated beam, the second opposing end defines an aperture. The pair of plates spaced such that the pair of plates of a first beam of a first collar element of the collar portion receives the beam of a second collar element of the collar portion to connect the respective collar elements together. In one or more embodiments, each collar element further includes one or more security rings that are sized and shaped to receive a security strap therein, the security strap including a biasing closure such as a ratchet handle, or a toggle action tightener, such as a chain binder.

BRIEF DESCRIPTION OF THE DRAWINGS

The aforementioned aspects, objects, features, advantages and embodiments of the present invention will be more fully understood and appreciated by those skilled in the art when considered in conjunction with the accompanying drawing figures, in which like reference characters designate the same or similar parts throughout the several views.

DETAILED DESCRIPTION OF THE PREFERRED EMBODIMENT AND OPERATION OF THE INVENTION

Figure 1:
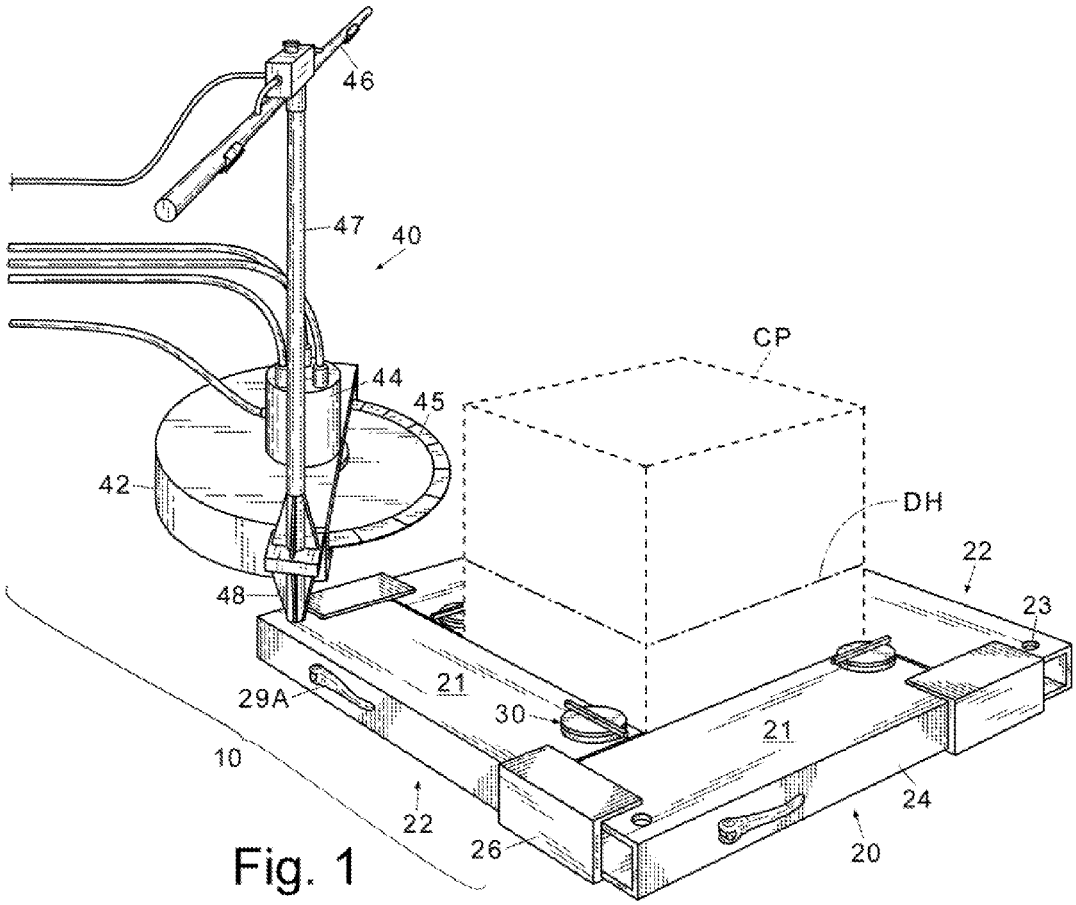
FIG. 1 is a perspective view showing a concrete pile cutting assembly having a collar portion and a cutting saw portion constructed in accordance with the present invention.

For a better understanding of the present invention and its operation, turning now to the drawings, FIG. 1 illustrates an exemplary embodiment of a concrete pile cutting assembly, also referred to herein as "the cutting assembly" and indicated generally by reference character 10, constructed in accordance with the present invention. The cutting assembly 10 is of the type commonly used to securely engage a concrete pile, indicated generally by reference character CP and shown in broken lines in FIG. 1, and to cut, or sever, a portion of the concrete pile. By way of example and not limitation, the concrete pile cutting assembly 10 may be used to sever an upper portion of a pre-cast concrete pile CP driven into the earth at a desired height in the construction of a structural support (e.g., foundation) for a building, bridge or roadway overpass. Alternatively, the cutting assembly 10 may be utilized to sever the base of a pre-cast or poured concrete pile CP after an upper portion of the concrete pile has been knocked over by a wrecking ball, sledge or the like, in the demolition of a structural support (e.g., foundation) for a building, bridge or roadway overpass. Regardless, it is desired that the concrete pile cutting assembly 10 can be assembled in situ and operated to cut, or sever, a portion of a concrete pile CP. It should be considered broadly, however, that the cutting assembly 10 may be utilized for any suitable purpose and may be utilized to cut, or sever, any suitable material at any desired height that may be reasonably discerned or envisioned by the invention as shown and described herein.

In the exemplary embodiment of the invention shown in FIG. 1, the concrete pile cutting assembly 10 comprises a collar portion, also referred to herein as the "collar" and indicated generally by reference character 20, and a cutting saw portion, also referred to herein as the "cutting saw" and indicated generally by reference character 40. Collar 20 is configured to securely engage the concrete pile CP at a location immediately adjacent to the desired height of the concrete pile, indicated generally by reference character DH and shown in phantom lines in FIG. 1. As shown herein, the collar 20 engages the concrete pile CP at a location below the cutting saw 40. However, as will be readily understood and appreciated by those skilled in the art, the collar 20 may be configured to engage the concrete pile CP at a location above the cutting saw 40, if desired. By way of example and not limitation, the collar 20 could be reversed on the concrete pile CP with the cutting saw 40 inverted, mounted beneath the collar and secured thereto. Alternatively, the mounting holes 23 provided on the beams 24 (to be described hereafter) of the collar 20 could extend through the collar so as to eliminate the need to reverse the collar. As used herein, the terms "engage" and "engages" with reference to the collar 20 and the concrete pile CP are intended to mean that the collar is positioned on and attached to, secured to, or otherwise held at a desired location on the concrete pile suitable for the cutting saw 40 to cut, or sever, the concrete pile at the desired height DH.

As shown herein, the collar portion 20 of the concrete pile cutting assembly 10 is ideally formed from a plurality of substantially identical collar elements 22. By way of example and not limitation, the collar 20 may be formed from a pair of generally L-shaped collar elements. Alternatively, as shown and described herein, the collar 20 is formed from four (4) substantially identical collar elements 22. Each collar element 22 comprises a beam 24 and a corresponding connecting flange 26. In the exemplary embodiment shown and described herein, the beam 24 is a generally rectangular, annular (i.e., hollow or open) box beam. However, the beam 24 may be solid and/or may have any suitable cross-sectional shape, such as square or cylindrical, as desired. The connecting flange, also referred to herein as the "flange, " 26 is shown herein as being generally C-shaped. However, as will be readily understood and appreciated by those skilled in the art, flange 26 will have a cross-sectional shape suitable for cooperating with the exterior shape of beam 24. Flange 26 is attached to beam 24 in any suitable manner, for example by frictional engagement, welding, brazing, soldering, gluing, riveting, bolting, screwing, or other fastening methods as appropriate. As such, flange 26 is preferably immovably fixed on beam 24.

Each beam 24 has at least one mounting hole 23 formed therein for a purpose to be described hereafter. As shown herein, a mounting hole 23 is provided at an outer corner on an upper surface 21 of the beam 24 adjacent the corresponding flange 26. Beam 24 further has at least one larger-sized opening 25 (FIG. 2) formed therethrough for receiving a corresponding locking insert 30, as will be described hereafter. As shown herein, the opening 25 is circular (round) and an optional cylindrical sleeve 28A may be provided and inserted within opening 25, if desired. However, opening 25 may have any desired shape, such as polygonal (e.g., square, rectangular, hexagon, octagon, etc.) or irregular, and sleeve 28A may have a corresponding shape. If utilized, sleeve 28A is provided with a through opening 28B for a purpose to be described hereafter. Furthermore, each beam 24 has at least one laterally extending through hole, or opening, 27 configured for receiving a corresponding locking rod 29A. As will be described in greater detail hereafter with reference to FIG. 3, the locking rod 29A of the beam 24 is provided to engage in a cam action manner with a locking insert 30 of an adjacent beam to secure the two beams together.

Figure 2:
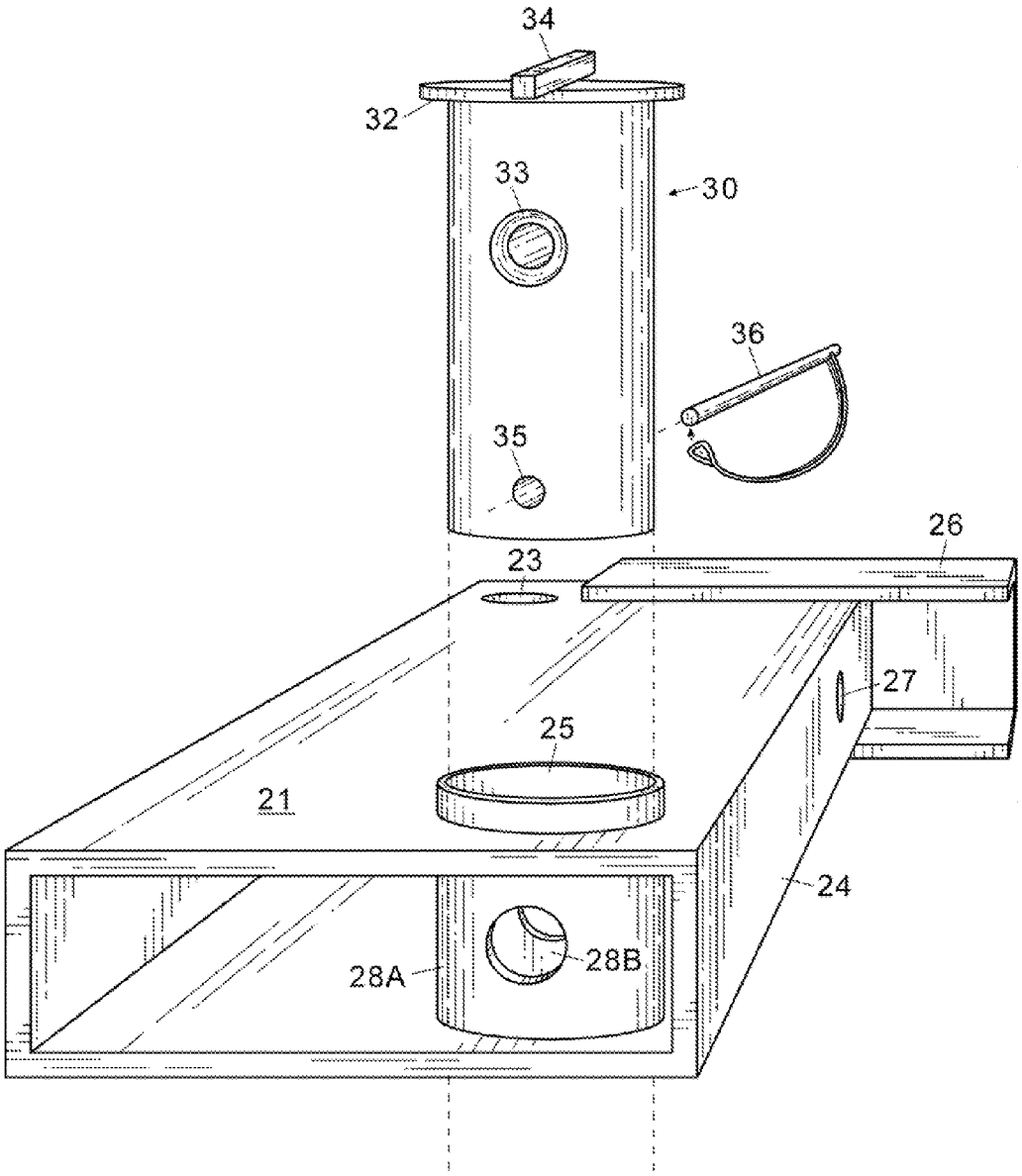
FIG. 2 is a partial perspective, exploded view of a typical locking insert of the collar portion of the concrete pile cutting assembly of FIG. 1 shown with the locking insert in a disassembled configuration.

Referring now to FIG. 2, a representative one of the locking insert 30 of the beam 24 is shown in a disassembled configuration. As shown herein, the locking insert 30 is cylindrical in shape and may be hollow (annular) or solid in cross-section. Regardless, locking insert 30 has a cap 32 affixed at one end that engages the upper surface 21 of the beam 24, or alternatively an upper surface of the optional sleeve 28A, when the locking insert is inserted into the opening 25 formed through the beam. In addition, cap 32 may be provided with an alignment element, for example a rectangular protrusion 34, that is operable for gripping the locking insert 30 as it is inserted into the opening 25 and/or sleeve 28A or removed therefrom, as well as for aligning the locking insert relative to the longitudinal length of the beam 24. As a result, an internally threaded opening 33 formed in the locking insert 30 is aligned with opening 28B of sleeve 28A and opening 27 of an adjacent beam 24 for a purpose to be described hereafter. If desired, locking insert 30 may also have an opening 35 formed therethrough for receiving a retaining clip 36 to retain the locking insert within the opening 25 and/or sleeve 28A in a known manner, for example while transporting a beam 24 of a disassembled collar portion 20 of the concrete pile cutting assembly 10.

Figure 3:
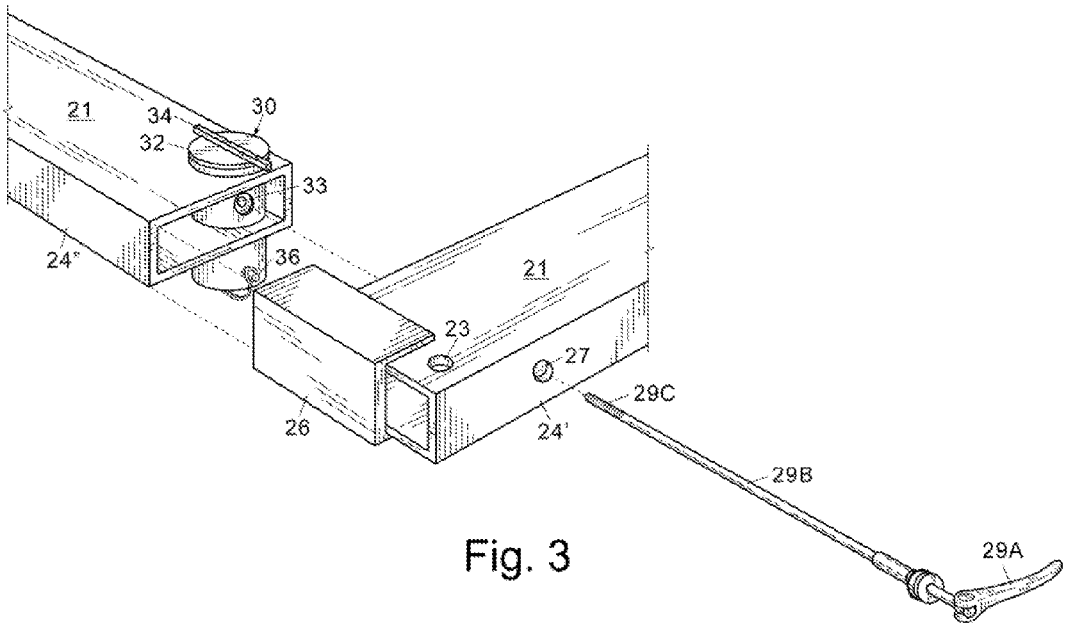
FIG. 3 is another partial perspective, exploded view of the locking insert and a typical locking rod for connecting adjacent beams of the collar portion of the concrete pile cutting assembly of FIG. 1 together with the beams shown in a disassembled configuration.

Referring now to FIG. 3, a typical locking insert 30 and a typical locking rod 29A for connecting together adjacent beams 24 of the collar portion 20 of the concrete pile cutting assembly 10 are shown. The locking rod 29A comprises an elongate shaft 29B that terminates with an externally threaded portion 29C at one end. The free end of the locking rod 29A having the externally threaded portion 29C is inserted through the opening 27 formed through a first beam 24' and so as to engage with the internally threaded opening 33 of the locking insert 30 of an adjacent second beam 24". The externally threaded portion 29C of the locking rod 29A engages the internally threaded opening 33 of the locking insert 30 to connect the adjacent beams 24' and 24" together. The cam action handle of locking rod 29A allows tightening more easily than the threads alone. It should be noted that concrete columns, piles, pilings and the like are typically formed with a somewhat standard sizing, and in particular, somewhat standard cross-sectional dimensions. As a result, the substantially identical beams 24 of the collar 20 may be formed with a predetermined longitudinal length and a predetermined lateral width. Regardless, the engagement of the externally threaded portion 29C of the locking rod 29A with the internally threaded opening 33 of the locking insert 30 permits the accommodation of concrete piles having a range of cross-sectional dimensions. However, the beams 24 need not be identical in longitudinal length and/or lateral width, or alternatively, the beams 24 may be formed with a varying longitudinal length and lateral width to accommodate different sizes of concrete columns, piles, pilings and the like.

Returning now to FIG. 1, the cutting saw portion 40 of the concrete pile cutting assembly 10 of the present invention is substantially conventional in configuration and operation. As such, the cutting saw 40 comprises a shroud, cover, base or the like 42 with a motor 44 disposed thereon. While motor 44 is preferably a hydraulic motor, it should be understood that power supplies such as electric motors, pneumatic motors, steam motors, or other power supplies are contemplated within the scope of the instant invention. In the exemplary embodiment shown in FIG. 1, the motor 44 is a hydraulic motor that is coupled to a hydraulic power source remote from the cutting saw 40. A cutting blade 45 is mounted by, for example, a drive shaft to motor 44 for rotation relative to the base 42 and the motor in a conventional manner. Cutting saw 40 further comprises an operating handle 46 attached to, for example, a periphery of the base 42 and preferably defines a "T" shape which allows the operator to comfortably apply feeding force with arm arms while holding one or more switches in the engaged position. In an embodiment, handle 46 includes a pair of opposingly oriented switches intended for engagement by both hands of a user, a safety mechanism without which the saw may not operate. Handle 46 may further include an emergency stop button located at the top of handle 46 that serves as an emergency stop to cut power to the saw when engaged. Handle 46 comprises a downwardly extending outboard leg 47 that terminates at a free end in a post 48. Post 48 of leg 47 is configured to engage a mounting hole 23 formed in one of the beams 24 of the collar portion 20 of the concrete pile cutting assembly 10. Post 48 engages with a mounting hole 23 so as to mount the cutting saw 40 onto the collar 20 of the cutting assembly 10. As such, the collar 20 supports and positions the cutting saw 40 adjacent the concrete pile CP at the desired height DH of the concrete pile to be cut, or severed. However, it should be noted that any suitable means may be employed for mounting, supporting, engaging and/or positioning the cutting saw 40 on the collar 20. By way of example and not limitation, one or more of the beams 24 of the collar 20 may be provided with a post in place of the mounting hole 23 and the cutting saw 40 may be provided with a corresponding sleeve configured to engage with the post to mount, position and/or support the cutting saw on the collar of the concrete pile cutting assembly 10.

In a method for cutting a concrete column, pile, piling or the like according to an exemplary embodiment of the present invention, a user locates a concrete pile CP to be cut, or severed, at a desired height DH. Next, the collar portion 20 of the concrete pile cutting assembly 10 is constructed around the concrete pile CP at a location such that the cutting saw portion 40 of the cutting assembly 10 will be positioned adjacent the desired height DH of the concrete pile CP. The collar portion 20 of the cutting assembly 10 is formed by connecting the beam 24' of a collar element 22 of the collar to the beam 24" of an adjacent collar element 22 of the collar using the locking rod 29A of the beam 24' and the locking insert 30 of the adjacent beam 24", as described with reference to FIG. 3 hereinabove. Each beam 24 of each collar element 22 is connected to a beam 24 of an adjacent collar element 22 and each locking rod 29A is tightly engaged with a corresponding locking insert 30 to secure the collar portion 20 of the concrete pile cutting assembly 10 in gripping relation with the concrete pile CP. Alternatively, the collar elements 22 of the portion 20 may be connected together loosely and the collar may be lowered over the top of the concrete pile CP and positioned such that the cutting saw 40 is adjacent the desired height DH. Each locking rod 29A is then tightly engaged with the corresponding locking insert 30 in the manner previously described. Regardless, with the collar portion 20 secured onto the concrete pile CP, the cutting saw portion 40 is mounted on the collar portion 20 by engaging the post 48 on the leg 47 of the operating handle 46 within one of the mounting holes 23 provided on the collar. Preferably, holes 23 are bushed such that post 48 may support the weight of the saw and maintain its alignment with respect to the pile being cut. The cutting saw 40 is then operated in a conventional manner and rotated, pivoted, or the like, bringing saw blade 45 into contact with concrete pile CP to cut, or sever, the concrete pile CP. As shown and described herein, the cutting saw 40 is configured to cut, or sever, the concrete pile CP with one or more cuts, for example in a single pass through the concrete pile or a pair of opposing cuts that are closely matched from side to side, ensuring a clean cut with minimal effort or expertise on the part of the user. However, in the event that the cutting blade 45 of the cutting saw 40 is undersized relative to the cross-sectional dimensions of the concrete pile CP, the cutting saw may be repositioned to another one of the mounting holes 23 provided on the collar 20 and operated to make a second cut through the thickness of the concrete pile. For example, larger pilings may be severed with multiple cuts, accommodated by additional holes 23 as needed.

Figure 4:
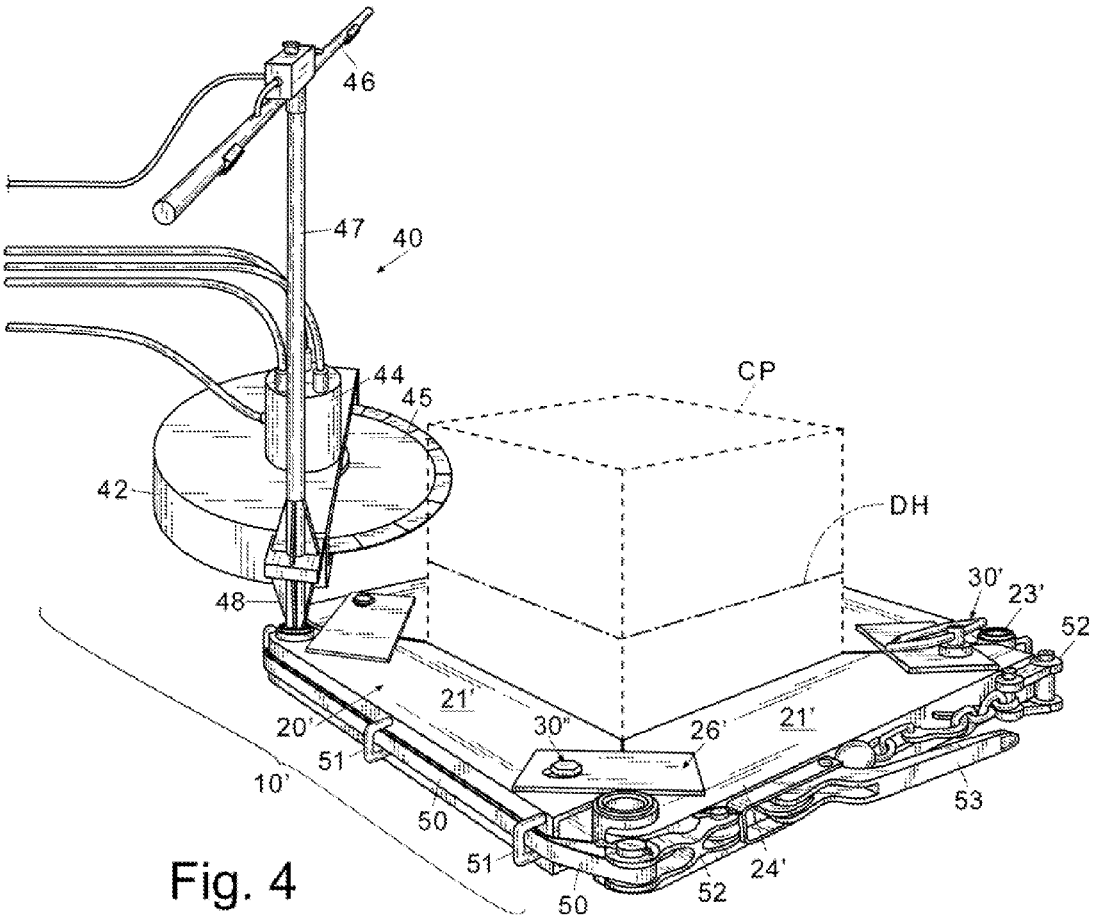
FIG. 4 is a perspective view showing an alternate embodiment of a concrete pile cutting assembly having a collar portion and a saw cutting portion constructed in accordance with the present invention.
Figure 5:
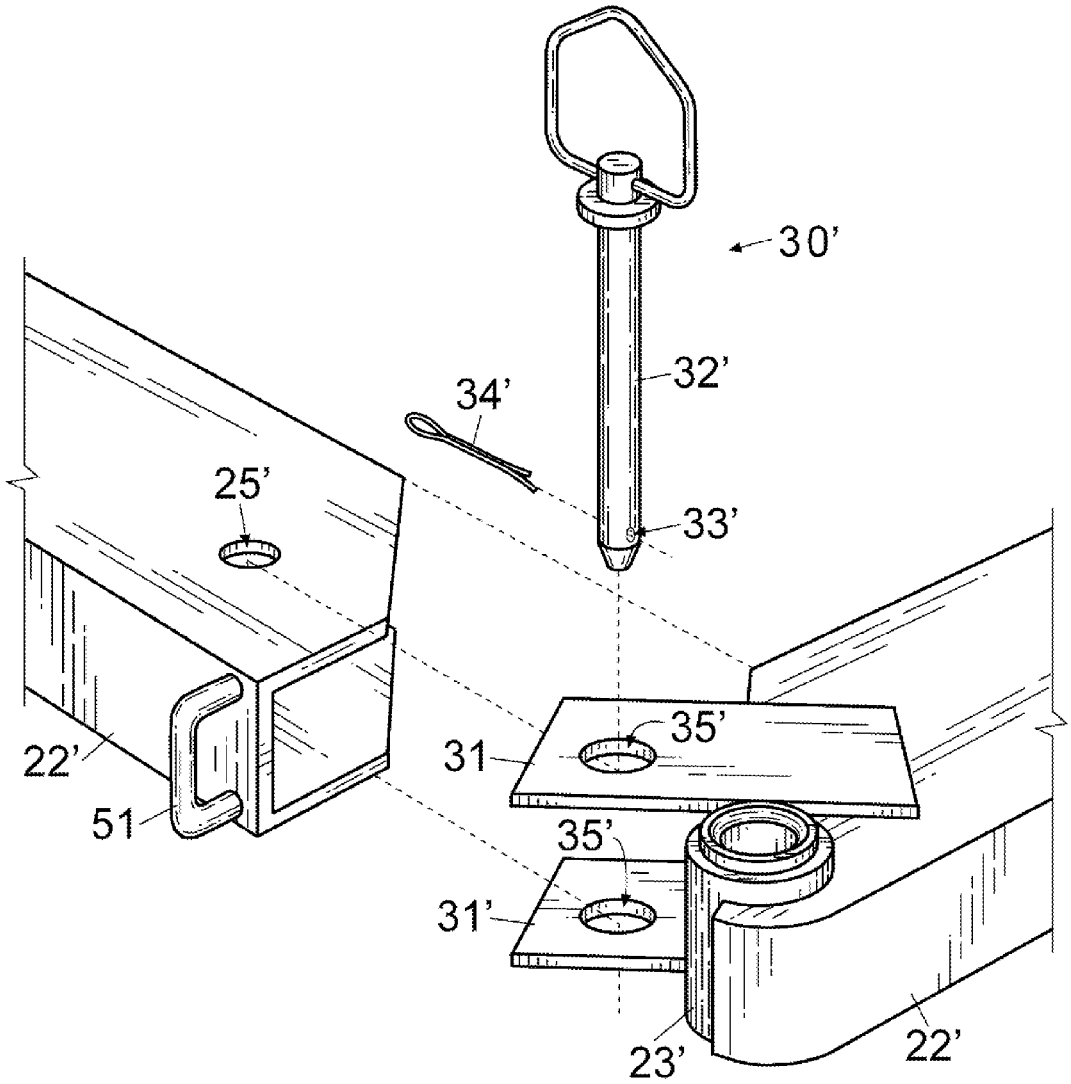
FIG. 5 is a partial perspective, exploded view of the end of a first collar end and a second collar end with the locking pin separated therefrom.

In an alternate embodiment of the invention shown in FIGS. 4-5, the concrete pile cutting assembly 10' comprises a collar portion, also referred to herein as the "collar" and indicated generally by reference character 20', and a cutting saw portion, also referred to herein as the "cutting saw" and indicated generally by reference character 40 as previous described. Collar 20' is configured to securely engage the concrete pile CP at a location immediately adjacent to the desired height of the concrete pile, indicated generally by reference character DH and shown in phantom lines in FIG. 4. As shown herein, the collar 20' engages the concrete pile CP at a location below the cutting saw 40. However, as will be readily understood and appreciated by those skilled in the art, the collar 20' may be configured to engage the concrete pile CP at a location above the cutting saw 40, if desired. By way of example and not limitation, the collar 20' could be reversed on the concrete pile CP with the cutting saw 40 inverted, mounted beneath the collar and secured thereto. Alternatively, the mounting cylinder 23' provided on the beams 24' (to be described hereafter) of the collar 20' could extend through the collar so as to eliminate the need to reverse the collar. As used herein, the terms "engage" and "engages" with reference to the collar 20' and the concrete pile CP are intended to mean that the collar is positioned on and attached to, secured to, or otherwise held at a desired location on the concrete pile suitable for the cutting saw 40 to cut, or sever, the concrete pile at the desired height DH.

As shown herein, the collar portion 20' of the concrete pile cutting assembly 10' is ideally formed from a plurality of substantially identical collar elements 22'. By way of example and not limitation, the collar 20' may be formed from a plurality of generally L-shaped collar elements 22' defining a substantially rectangular cross-section. Alternatively, as shown and described herein, the collar 20' is formed from four (4) substantially identical collar elements 22'. Each collar element 22' comprises a beam 24' and a corresponding connecting flange 26' formed by plates 31, 31'. In the exemplary embodiment shown and described herein, the beam 24' is a generally rectangular, annular (i.e., hollow or open) box beam. However, the beam 24' may be solid and/or may have any suitable cross-sectional shape, such as square or cylindrical, as desired. The connecting flange, also referred to herein as the "flange," 26' in conjunction with beam 24" is shown herein as being generally C-shaped and is positioned at approximately a forty-five degree (45°) angle proximate one end of each collar element 22'. However, as will be readily understood and appreciated by those skilled in the art, flange 26' will have a cross-sectional shape suitable for cooperating with the exterior shape of beam 24', and the angle of attachment may vary to accommodate various sizes of concrete piling CP. A first end of flange 26' is attached to beam 24' in any suitable manner, for example by frictional engagement, welding, brazing, soldering, gluing, riveting, bolting, screwing, or the like, and as such, is preferably immovably fixed on beam 24'. A second, longitudinally opposing end of flange 26' defines opening 35' that co-aligns with opening 25' formed in upper surface 21' of each beam 24' and therefore permits relative rotation of collar elements 22'. Although the shape of opening 35' is not intended to be limiting, preferred opening 35' defines an elongated circular (i.e. slotted) shape to allow for slight adjustments in the event precise measurements are not available to perfectly align openings 35' and 25', respectfully.

Each beam 24' has at least one mounting cylinder 23' with a central aperture formed therein for the purpose of receiving saw post 48 therein. As shown herein, a mounting cylinder 23' is provided at an outer corner on an upper surface 21' of the beam 24' adjacent the corresponding flange 26'. Beam 24' further has at least opening 25' (FIG. 5) formed therethrough for receiving a corresponding locking fastener 30', as will be described hereafter. As shown herein, the opening 25' is circular (round) but opening 25' may have any desired shape, such as polygonal (e.g., square, rectangular, hexagon, octagon, etc.). As will be described in greater detail hereafter with reference to FIG. 5, a locking fastener 30' of each beam 24' is provided to engage flange 26' with an opening 25' of an adjacent beam 24' to secure the two beams together. As shown and understood in the representative embodiment of collar 20' in FIG. 4, three of the four corner collar elements 22' are connected with fixedly attached locking fasteners 30", for example a threaded fastener such as a bolt and a corresponding nut (not shown) which is intended to be installed and not removed repeatedly, permitting rotation about this relatively permanent axle. The fourth corner, which is the corner engagement demonstrated more fully in FIG. 5, is connected by a more releasable locking fastener 30' such as shaft 32' defining aperture 33' therethrough that is sized and shaped to receive pin 34' therein after insertion of shaft 32' through openings 35' in plates 31, 31' of collar element 22'. In order to accommodate the engagement of respective first and second collar elements 22' as demonstrated, preferred collar elements 22' define an angular terminal end to facilitate proximal colocalization of respective collar elements 22'.

Referring now to FIG. 5, a representative locking fastener 30' (FIG. 4) in the nature of shaft 32' in connection with beam 24' (FIG. 4) is shown in exploded configuration. As shown herein, shaft 32' is cylindrical in shape and may be hollow (annular) or solid in cross-section and is sized to be insertable through flange openings 35' and 25', where it can be secured with pin 34'. This orientation may be the only removable deployment of locking fastener 30', such that the other corners of collar 20' need not be removed when collar 20' is removed from concrete piling CP. This configuration permits the removal of a single locking fastener 30', namely shaft 32', to disassociate collar 20' from concrete piling CP.

Returning to FIG. 4, in addition to the engagement of locking fasteners 30', a preferred embodiment of collar 20' may further include biasing member 50 passing around the periphery of collar elements 22' and through a plurality of rings 51 defined on an external surface thereof. In a representative embodiment, but not intended as a limitation, biasing member 50 may be in the embodiment of a wire rope, chain, fabric, polymeric, or blending composition strap that terminates at opposing ends in a loop that may be engaged with a mounting spool known as a component of a chain binder. While a single side of collar 20' is demonstrated in FIG. 4 with rings 51, it should be understood that the number, size, and placement of rings 51 may extend about the entire outer periphery of collar 20'. In order to engage or disengage biasing member 50, one or more chain binder elements may be disengaged from respective brackets 52 and passed over an axle before the chain binder is replaced. The brackets in turn are in communication with pulling device 53, for example a chain link puller as is known in the art as a chain binder. When relaxed, biasing member 50 may be slack against respective sections of collar 20', but when puller 53 pulls biasing member 50 into close, frictional engagement with the periphery of collar 20', biasing member 50 becomes taught further enhancing the engagement with concrete piling CP. The chain binder quickly engages and disengages shorts lengths of chain attached to the strap, enabling the collar to be conveniently placed or removed.

The foregoing detailed description of exemplary embodiments of the present invention discloses a concrete pile cutting assembly having a collar and a cutting saw. The collar is configured to securely engage a concrete pile and support the cutting saw on the collar such that the saw blade does not bind in the cut, prolonging blade life and speeding the cutting process. In a particularly advantageous embodiment, the concrete pile cutting assembly has a collar that mounts a cutting saw adjacent a concrete pile in a manner that allows the cutting saw to cut, or sever, the concrete pile with one or more cuts. However, it should be noted and will be readily apparent to and understood and appreciated by those skilled in the art that the drawings, figures, illustrations, examples and embodiments provided herein are for the purpose of providing a complete, accurate and enabling disclosure of the present invention only and are not intended to limit the scope of the following appended claims in any manner. Accordingly, it is envisioned that other structures, mechanisms, configurations and movements may be utilized to accomplish the same or similar functions with the same or similar results without departing from the intended scope of the appended claims.

I claim:

1. A concrete pile cutting assembly, comprising:

a collar portion configured for securely engaging a concrete pile; and a cutting saw portion comprising a circular cutting blade with a handle, the handle further comprising a central leg positioned between a grip and a post, the central leg extending vertically above a horizontal plane defined by the cutting blade, the grip defining a "T" shape with portions that extend generally perpendicular relative to the handle, the grip attached to a longitudinal end of the central leg above the horizontal plane defined by the cutting blade, and the post defined at an opposing longitudinal end of the handle relative to the grip, the post extending vertically below the horizontal plane defined by the cutting blade in a generally coaxial relationship relative to the central leg;

wherein the collar portion comprises a plurality of substantially identical collar elements that are connected together to form the collar portion, at least one of the collar elements defining a mounting cylinder sized and shaped to receive the post therein and carry the saw cutting portion;

wherein the collar portion is further configured to receive the cutting saw portion via insertion of the post extending vertically below the cutting blade into the mounting cylinder to position the cutting blade above the collar portion and rotatably disposed about the post to be positioned adjacent to the concrete pile at a desired height to cut the concrete pile; and wherein the cutting saw portion produces a clean cut through the concrete pile at the desired height relative to the concrete pile via rotational urging at the grip portions, pivoting the cutting blade in an arc about an axis defined by the post, the post positioned outside a vertical cylinder defined by an outermost circumference of the cutting blade.

2. The concrete pile cutting assembly according to claim 1, wherein each of the plurality of collar elements is an elongate beam.

3. The concrete pile cutting assembly according to claim 2, wherein each beam has a generally rectangular cross-section.

4. The concrete pile cutting assembly according to claim 1, wherein each of the plurality of collar elements comprises at least a beam defining an opening and a locking fastener.

5. The concrete pile cutting assembly according to claim 4, wherein the locking fastener of a first beam of a first collar element of the collar portion engages with a second beam of a second collar element of the collar portion via an opening therein to connect the first collar element and the second collar element together.

6. The concrete pile cutting assembly according to claim 4, wherein each of the plurality of collar elements further comprises a connecting flange.

7. The concrete pile cutting assembly according to claim 4 further comprising a pin, wherein at least one of the locking fasteners comprise an elongate shaft that defines an aperture, and wherein the pin is configured for engaging with the locking fastener via the aperture to secure a first collar element to another collar element.

8. A method for cutting a concrete pile, comprising:

providing a concrete pile cutting assembly, comprising:

a collar portion configured for securely engaging a concrete pile; and a cutting saw portion comprising a circular cutting blade with a handle, the handle further comprising a central leg positioned between a grip and a post, the central leg extending vertically above a horizontal plane defined by the cutting blade, the grip defining a "T" shape with portions that extend generally perpendicular relative to the handle, the grip attached to a longitudinal end of the central leg above the horizontal plane defined by the cutting blade, and the post defined at an opposing longitudinal end of the handle relative to the grip, the post extending vertically below the horizontal plane defined by the cutting blade in a generally coaxial relationship relative to the central leg; wherein the collar portion comprises a plurality of substantially identical collar elements, at least one of the collar elements defining a mounting cylinder sized and shaped to receive the post therein and carry the saw cutting portion; wherein the collar portion is further configured to receive the cutting saw portion via insertion of the post extending vertically below the cutting blade into the mounting cylinder to position the cutting blade above the collar portion;

connecting the plurality of collar elements together;

lifting the collar portion and securely engaging the concrete pile with the plurality of collar elements;

mounting the cutting saw portion on the collar portion; and pivoting the cutting blade through the concrete pile, producing a clean cut through the concrete pile at the desired height relative to the concrete pile via rotational urging at the grip portion, pivoting the cutting blade in an arc about an axis defined by the post, the post positioned outside a vertical cylinder defined by an outermost circumference of the cutting blade, while a user remains standing.

9. The method according to claim 8, wherein connecting the plurality of collar elements together comprises connecting a first beam of a first one of the plurality of collar elements to a second beam of another one of the plurality of collar elements using a locking fastener of the first beam inserted into a beam opening of the second beam.

10. The method according to claim 8, wherein each of the plurality of collar elements comprises a beam, a locking fastener, and a beam opening for receiving a locking fastener therein.

11. The method according to claim 10, wherein connecting the plurality of collar elements together comprises inserting the first locking fastener of a first collar element into the beam opening of an adjacent one of the plurality of collar elements.

* * * * *